US009536162B2

(12) United States Patent
Lee et al.

(10) Patent No.: US 9,536,162 B2
(45) Date of Patent: Jan. 3, 2017

(54) METHOD FOR DETECTING AN INVISIBLE MARK ON A CARD

(75) Inventors: Joong Lee, Seoul (KR); Tae-Yi Kang, Seoul (KR); Jun Seok Byun, Gyeonggi-do (KR)

(73) Assignee: Republic of Korea (National Forensic Service Director Ministry of Public Administration and Security), Seoul (KR)

( * ) Notice: Subject to any disclaimer, the term of this patent is extended or adjusted under 35 U.S.C. 154(b) by 135 days.

(21) Appl. No.: 13/980,150

(22) PCT Filed: Dec. 19, 2011

(86) PCT No.: PCT/KR2011/009806

§ 371 (c)(1),
(2), (4) Date: Sep. 13, 2013

(87) PCT Pub. No.: WO2012/099337

PCT Pub. Date: Jul. 26, 2012

(65) Prior Publication Data

US 2013/0343599 A1 Dec. 26, 2013

(30) Foreign Application Priority Data

Jan. 17, 2011 (KR) ..... 10-2011-0004593
Mar. 24, 2011 (KR) ..... 10-2011-0026150

(51) Int. Cl.
*G06K 9/00* (2006.01)
*G06K 9/20* (2006.01)
(Continued)

(52) U.S. Cl.
CPC ..... *G06K 9/2063* (2013.01); *A63F 1/18* (2013.01); *A63F 2009/063* (2013.01); *A63F 2009/2444* (2013.01); *A63F 2250/58* (2013.01)

(58) Field of Classification Search
CPC ..... G06K 99/22; A63F 2001/003
(Continued)

(56) References Cited

U.S. PATENT DOCUMENTS 6,463,173 B1 * 10/2002 Tretter ..... 382/168
7,220,535 B2 * 5/2007 Lawandy et al. ..... 430/336
(Continued)

FOREIGN PATENT DOCUMENTS

EP 1 300 810 A2 4/2003
JP 2006-268142 A 10/2006
KR 10-0881230 B1 2/2009

OTHER PUBLICATIONS

U.S. Appl. No. 61/046,080.*

*Primary Examiner* — Kim Vu
*Assistant Examiner* — Molly Delaney
(74) *Attorney, Agent, or Firm* — Rabin & Berdo, P.C.

(57) ABSTRACT

The present invention relates to a method for detecting a mark that is invisible in the visible light region. Here, the invisible mark is displayed on a card using a characteristic according to which the color of light is changed by means of a refractive index difference according to media in the visible light region. According to the method for detecting the invisible mark, it may be quickly determined whether the card is a counterfeit card in an investigation. In addition, since it is unnecessary to repeatedly inspect the card to be checked using various wavelengths, the time required for determining whether the card is a counterfeit card may be reduced.

8 Claims, 14 Drawing Sheets

(51) Int. Cl.
*A63F 1/18* (2006.01)
*A63F 9/06* (2006.01)
*A63F 9/24* (2006.01)

(58) Field of Classification Search
USPC ..... 382/112, 165, 169
See application file for complete search history.

(56) References Cited

U.S. PATENT DOCUMENTS

| | | | | |
|---|---|---|---|---|
| 7,474,785 | B2 * | 1/2009 | Wu et al. | 382/168 |
| 7,488,813 | B2 * | 2/2009 | Pollock et al. | 536/23.1 |
| 8,837,804 | B2 * | 9/2014 | Su et al. | 382/135 |
| 8,879,832 | B2 * | 11/2014 | Dalal et al. | 382/162 |
| 2006/0072778 | A1 * | 4/2006 | Harrington | 382/100 |
| 2009/0291758 | A1 * | 11/2009 | Moretti et al. | 463/31 |
| 2010/0214392 | A1 * | 8/2010 | Klimenko | 348/36 |
| 2012/0014449 | A1 * | 1/2012 | Park et al. | 375/240.16 |
| 2012/0051650 | A1 * | 3/2012 | Aisaka et al. | 382/195 |
| 2012/0062957 | A1 * | 3/2012 | Safonov et al. | 358/3.01 |
| 2013/0136352 | A1 * | 5/2013 | Naccari et al. | 382/165 |
| 2014/0218769 | A1 * | 8/2014 | Tolstaya et al. | 358/2.1 |

* cited by examiner

METHOD FOR DETECTING AN INVISIBLE MARK ON A CARD

TECHNICAL FIELD

The present invention relates to a method of detecting an invisible mark in a card and, more particularly, to a method of detecting an invisible mark (not seen by the naked eye) indicated in a card in a visible ray region using a characteristic in which a color tone of light is changed due to a difference in the refractive index of a wavelength according to a medium in the visible ray region.

BACKGROUND ART

A method now being widely used, from among several techniques used in fraudulent gambling using a card, such as trump or Korean playing cards (hereinafter referred to as a 'card'), is a method in which a criminal indicates an invisible substance, such as ultraviolet or infrared ink, on the back of a card and then checks the contents of the card using a special lens, an infrared camera, or an ultraviolet camera, etc.

In general, if an accusation is brought for fraudulent gambling or a gambling scene is arrested, an investigative agency has to often check whether or not a card used is a fraudulent card.

In this case, an appraisal institution is requested to determine whether or not the card is a fraudulent card. In general, appraisers or criminal investigators could know whether or not a mark is present on the back of the card through experiments using a special device on which light of an invisible ray region, such as ultraviolet or infrared, or a bandpass filter of an invisible ray region is mounted.

However, this special device is problematic in that it is expensive and a lot of time is taken to examine whether or not the card is a fraudulent card because a light source having several wavelengths needs to be repeatedly radiated.

DISCLOSURE

Technical Problem

The present invention has been made to solve the above-described problems, and the present invention provides a method of detecting an invisible mark in a card, which can rapidly determine whether a card is a fraudulent card in a criminal investigation and reducing the time taken to determine whether the card is a fraudulent card because an appraiser does not need to repeatedly illuminate the card over several wavelengths by detecting an invisible mark indicated in the card in a visible ray region using a characteristic in which a color tone of light is changed due to a difference in the refractive index of a wavelength according to a medium in the visible ray region.

Technical Solution

A method of detecting an invisible mark in a card according to the present invention for achieving the above object includes (a) a normalization step for calculating first normal light, second normal light, and third normal light by normalizing first light, second light, and third light that form respective pixels in an extraction image of the card; (b) a chrominance calculation step for obtaining first chrominance light, second chrominance light, and third chrominance light by calculating a difference in a color tone between two pieces of normal light not overlapping with each other, from among the first normal light, the second normal light, and the third normal light normalized in the step (a); and (c) an image acquisition step for calculating histograms of the first chrominance light, the second chrominance light, and the third chrominance light calculated in the step (b) and obtaining a detection image of the card by stretching the histograms so that first distribution light, second distribution light, and third distribution light forming one pixel are calculated.

A step of capturing the extraction image of the card through a camera embedded in a mobile phone or transmitting the extraction image to a mobile phone and storing the transmitted extraction image may be included.

The normalization step may include steps of calculating a dark and shade value $\mathrm{Gray}_{(x,y)}$ for each pixel, calculating an average dark and shade value $\mathrm{Gray}_{mean)}$ for a sum of the dark and shade values $\mathrm{Gray}_{(x,y)}$, and calculating first average light, second average light, and third average light to which the average dark and shade value $\mathrm{Gray}_{(mean)}$ has been applied to the first light, the second light, and the third light; and calculating the first normal light, the second normal light, and the third normal light normalized by stretching the histograms of remaining two pieces of average light based on the histogram of any one piece of average light, from among the first average light, the second average light, and the third average light.

The dark and shade value $\mathrm{Gray}_{(x,y)}$ may be calculated by $$\mathrm{Gray}_{(x,y)} = \frac{R_{(x,y)} + G_{(x,y)} + B_{(x,y)}}{3}$$

(wherein $R_{(x,y)}$ is the first light forming the pixel, $G_{(x,y)}$ is the second light forming the pixel, $B_{(x,y)}$ is the third light forming the pixel, and (x, y) is coordinates of the pixel), the first average light, the second average light, and the third average light may be calculated by $$R'_{(x,y)} = \frac{R_{(x,y)}}{\mathrm{Gray}_{(x,y)}} \times \mathrm{Gray}_{(mean)},\ G'_{(x,y)} = \frac{G_{(x,y)}}{\mathrm{Gray}_{(x,y)}} \times \mathrm{Gray}_{(mean)},$$

$$\text{and } B'_{(x,y)} = \frac{B_{(x,y)}}{\mathrm{Gray}_{(x,y)}} \times \mathrm{Gray}_{(mean)},$$

respectively (wherein $R'_{(x,y)}$ is the first average light in which the average dark and shade value has been applied to the first light, $G'_{(x,y)}$ is the second average light in which the average dark and shade value has been applied to the second light, and $B'_{(x,y)}$ is the third average light in which the average dark and shade value has been applied to the third light), and the first normal light, the second normal light, and the third normal light may be calculated by $$R''_{(x,y)} = 255 \times \frac{R'_{(x,y)} - G'_{(min)}}{G'_{(max)} - G'_{(min)}} \times \mathrm{Gray}_{(mean)},$$

$$B''_{(x,y)} = 255 \times \frac{B'_{(x,y)} - G'_{(min)}}{G'_{(max)} - G'_{(min)}} \times \mathrm{Gray}_{(mean)},$$

and $G''_{(x,y)}$, respectively (wherein $R'_{(x,y)}$ is the first normal light histogram-stretched from the first average light based on the histogram of the second average light, $B''_{(x,y)}$ is the third normal light histogram-stretched from the third average light based on the histogram of the second average light, $G''_{(x,y)}$ is the second normal light and identical with the second average light, $G'_{(min)}$ is a minimum value of the second average light, and $G'_{(max)}$ is a maximum value of the second average light).

The chrominance calculation step may steps of calculating an absolute value for a difference between the first normal light and the second normal light, an absolute value for a difference between the first normal light and the third normal light, and an absolute value for a difference between the second normal light and the third normal light, and matching the absolute values with the first chrominance light, the second chrominance light, and the third chrominance light, respectively.

The first chrominance light, the second chrominance light, and the third chrominance light may be calculated by $K_{1(x,y)}=|R''_{(x,y)}-G''_{(x,y)}|$, $K_{2(x,y)}=|R-_{(x,y)}-B''_{(x,y)}|$, and $K_{3(x,y)}=|G''_{(x,y)}-B''_{(x,y)}|$, respectively (wherein $K_{1(x,y)}$ is the first chrominance light matched with the absolute value for the difference between the first normal light and the second normal light, $K_{2(x,y)}$ is the second chrominance light matched with the absolute value for the difference between the first normal light and the third normal light, and $K_{3(x,y)}$ is the third chrominance light matched with the absolute value for the difference between the second normal light and the third normal light).

The image acquisition step may include steps of calculating the histograms of the first chrominance light, the second chrominance light, and the third chrominance light, and calculating the first distribution light, the second distribution light, and the third distribution light forming one pixel by stretching the histograms.

The first distribution light, the second distribution light, and the third distribution light may be calculated by $$K'_{1(x,y)} = 255 \times \frac{K_{1(x,y)} - K_{1(min)}}{K_{1(max)} - K_{1(min)}},\ K'_{2(x,y)} = 255 \times \frac{K_{2(x,y)} - K_{2(min)}}{K_{2(max)} - K_{2(min)}},$$

$$\text{and } K'_{3(x,y)} = 255 \times \frac{K_{3(x,y)} - K_{3(min)}}{K_{3(max)} - K_{3(min)}},$$

respectively (wherein $K'_{1(x,y)}$ is the first distribution light calculated by the histogram stretching for the first chrominance light, $K_{1(min)}$ is a minimum value of the first chrominance light, $K_{1(max)}$ is a maximum value of the first chrominance light, $K'_{2(x,y)}$ is the second distribution light calculated by the histogram stretching for the second chrominance light, $K_{2(min)}$ is a minimum value of the second chrominance light, $K_{2(max)}$ is a maximum value of the second chrominance light, $K'_{3(x,y)}$ is the third distribution light calculated by the histogram stretching for the third chrominance light, $K_{3(min)}$ is a minimum value of the third chrominance light, and $K_{3(max)}$ is a maximum value of the third chrominance light).

Advantageous Effects

In accordance with the method of detecting an invisible mark in a card according to the present invention described above, an invisible mark indicated in the card is detected in a visible ray region using a characteristic in which a color tone of light is changed due to a difference in the refractive index of a wavelength according to a medium in the visible ray region. Accordingly, there are advantages in that whether a card is a fraudulent card can be rapidly determined in a criminal investigation and the time taken to determine whether the card is a fraudulent card can be reduced because an appraiser does not need to repeatedly illuminate the card over several wavelengths.

MODE FOR INVENTION

Hereinafter, a preferred embodiment of the present invention is described in detail with reference to the accompanying drawings in order to describe the present invention in detail so that a person having ordinary skill in the art to which the present invention pertains can readily implement the present invention.

Figure 1:
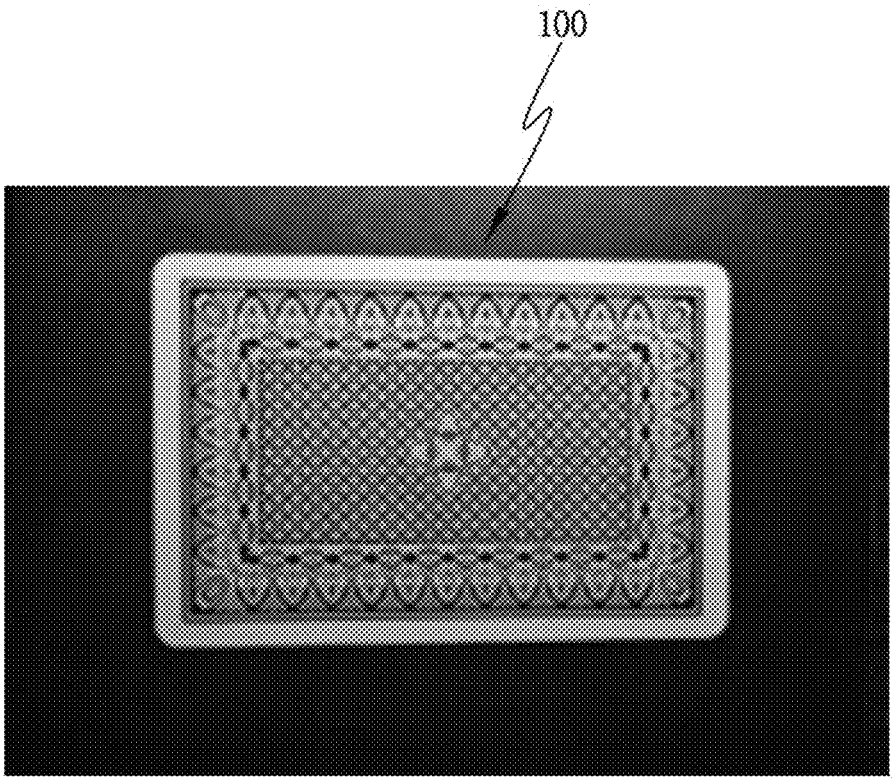
FIG. 1 is an exemplary diagram illustrating a captured image of a card in order to detect an invisible mark in a card in accordance with an embodiment of the present invention.
Figure 2:
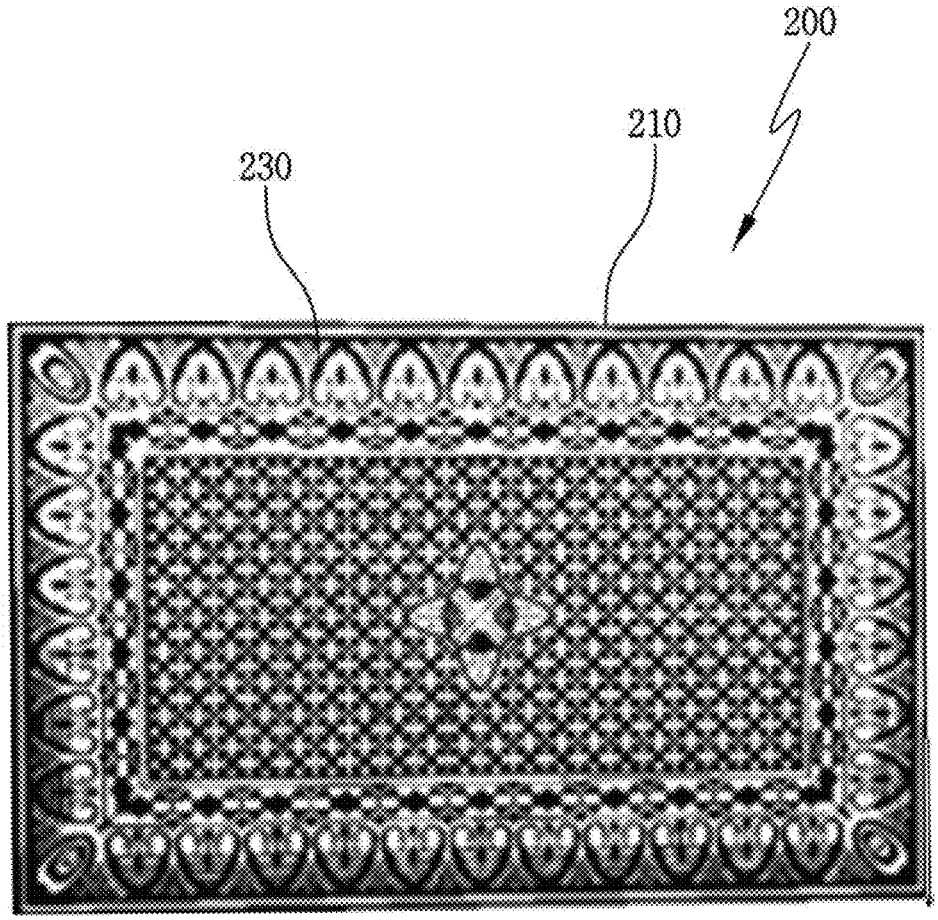
FIG. 2 is an exemplary diagram illustrating an image of only the card portion extracted from the image of FIG. 1.
Figure 3:
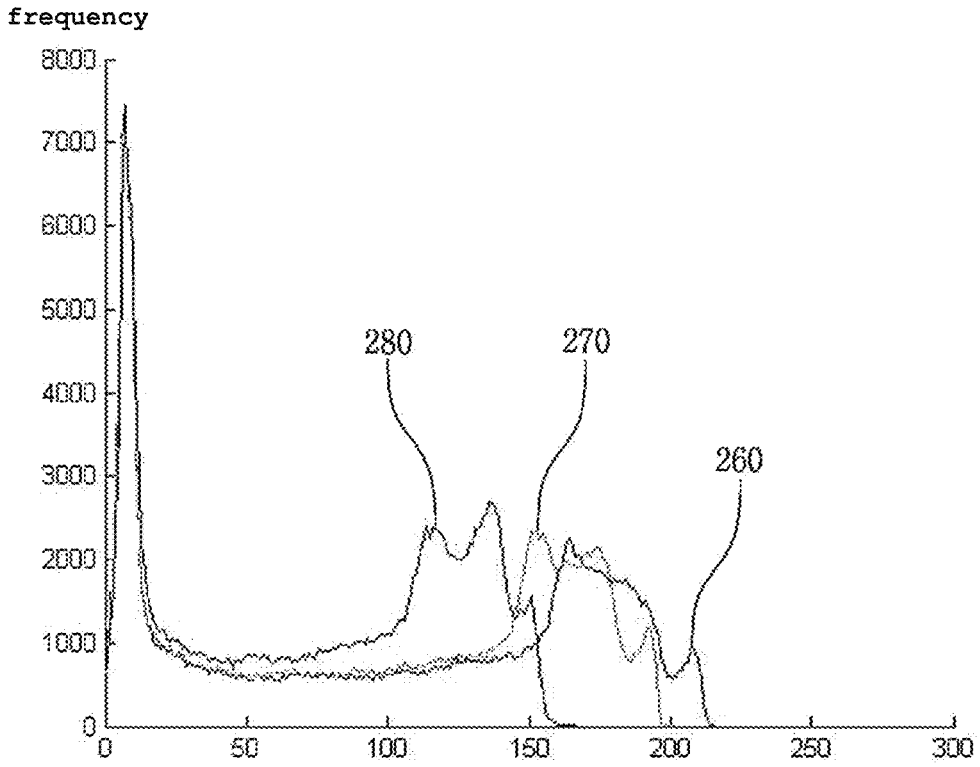
FIG. 3 is an exemplary diagram illustrating a histogram for plural pieces of light that form the pixels of the image in the image of FIG. 2.
Figure 4:
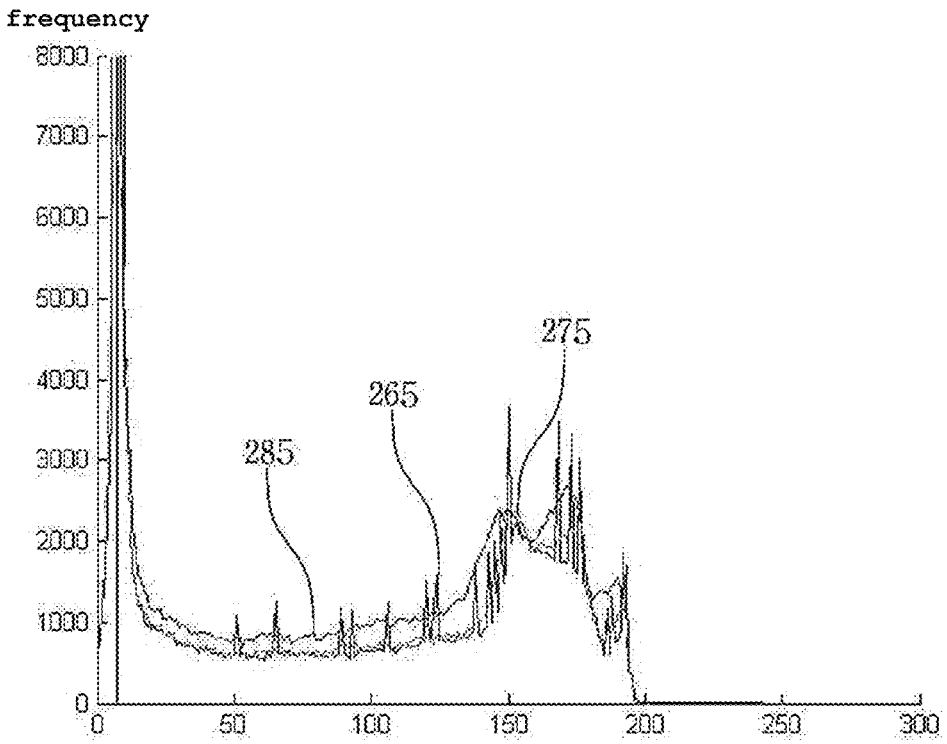
FIG. 4 is an exemplary diagram illustrating an example in which the remaining pieces of light have been stretched on the basis of a piece of light in the histogram of FIG. 3.
Figure 5:
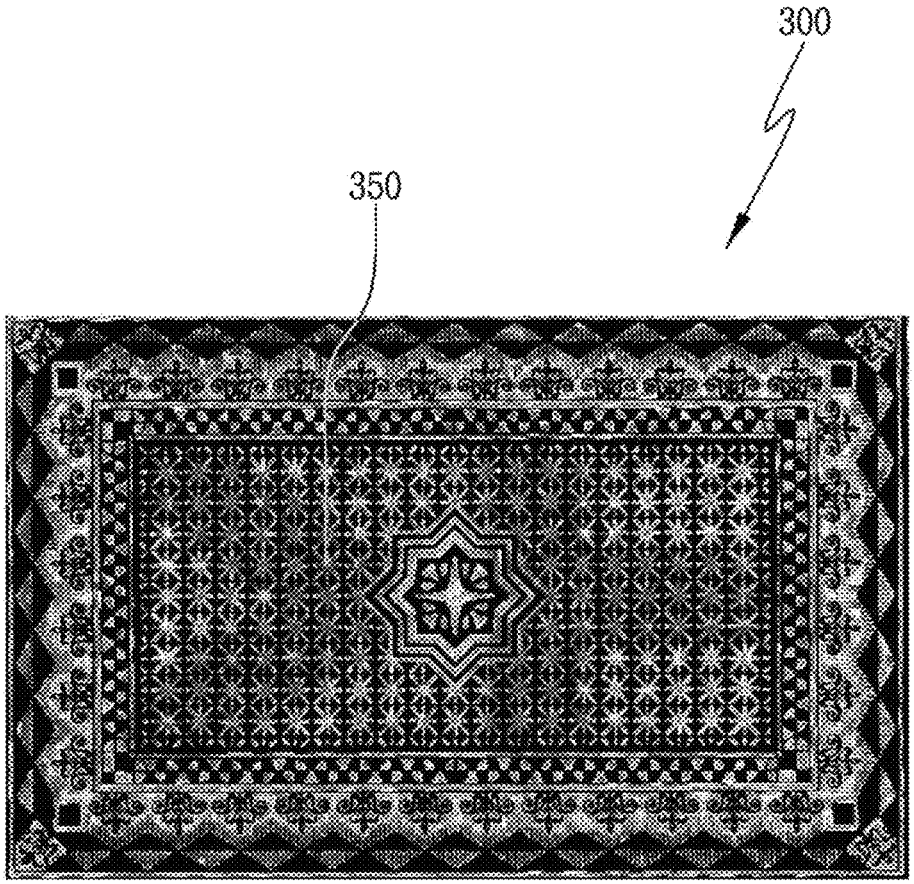
FIG. 5 is an exemplary diagram illustrating the state in which an invisible mark has been detected in a card in accordance with an embodiment of the present invention.
Figure 6:
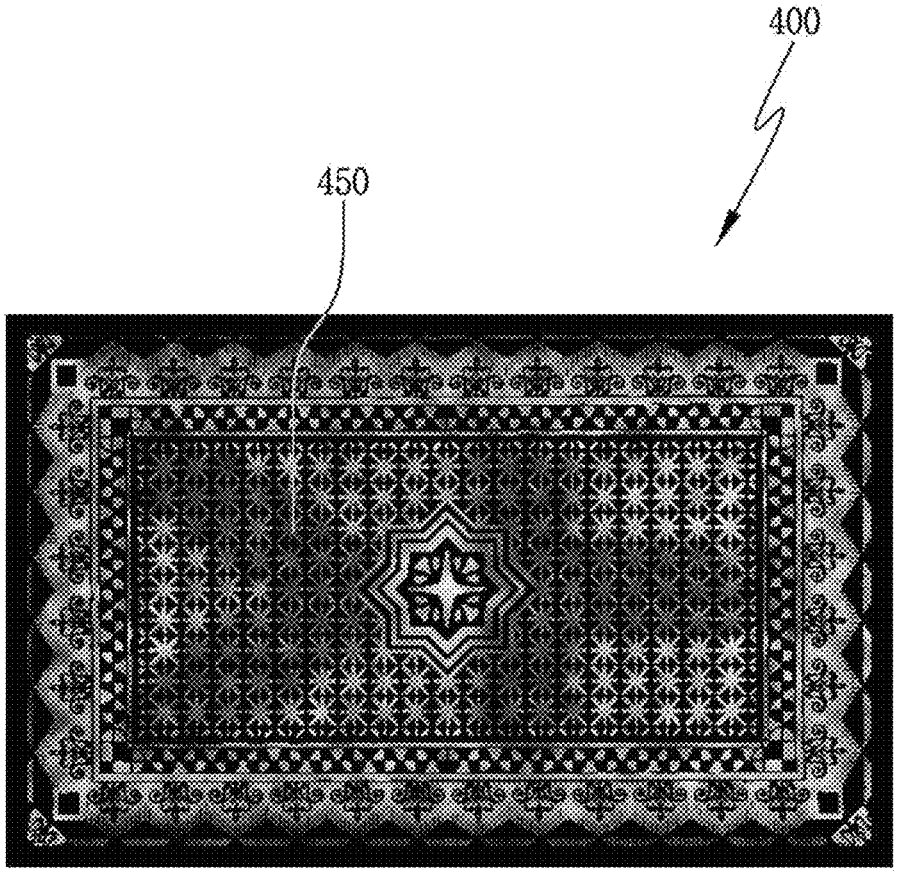
FIG. 6 is an exemplary diagram illustrating the state in which noise has been removed in the state in which an invisible mark has been detected in a card in accordance with an embodiment of the present invention.
Figure 7:
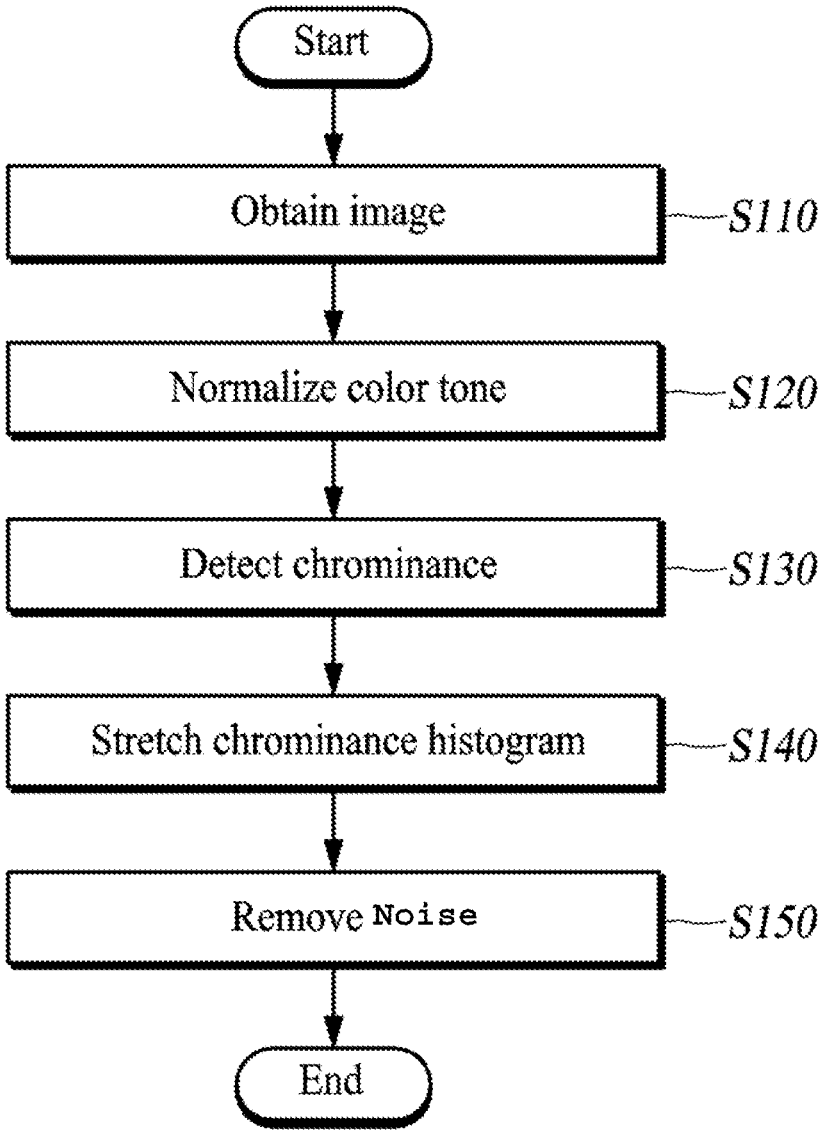
FIG. 7 is a flowchart illustrating a method of detecting an invisible mark in a card in accordance with an embodiment of the present invention.

FIG. 1 is an exemplary diagram illustrating a captured image of a card in order to detect an invisible mark in a card in accordance with an embodiment of the present invention, FIG. 2 is an exemplary diagram illustrating an image of only the card portion extracted from the image of FIG. 1, FIG. 3 is an exemplary diagram illustrating a histogram for plural pieces of light that form the pixels of the image in the image of FIG. 2, FIG. 4 is an exemplary diagram illustrating an example in which the remaining pieces of light have been stretched on the basis of a piece of light in the histogram of FIG. 3, FIG. 5 is an exemplary diagram illustrating the state in which an invisible mark has been detected in a card in accordance with an embodiment of the present invention, FIG. 6 is an exemplary diagram illustrating the state in which noise has been removed in the state in which an invisible mark has been detected in a card in accordance with an embodiment of the present invention, and FIG. 7 is a flowchart illustrating a method of detecting an invisible mark in a card in accordance with an embodiment of the present invention.

In order to detect an invisible mark in a card, such as trump or Korean playing cards in accordance with an embodiment of the present invention, first, a card image 100 needs to be obtained by photographing a card as shown in FIG. 1 (step S110).

The user of a mobile phone (not shown) may obtain the card image 100 by photographing the card through the manipulation of the mobile phone.

Here, the mobile phone can be a cellular phone or smart phone equipped with an internal or external camera and may include a Personal Digital Assistant (PDA) including a camera, a Portable Multimedia Player (PMP) including a camera, or the like.

Furthermore, the method according to step S110 and steps S120 to S150 to be described later can be programmed and stored in the mobile phone.

In particular, if the mobile phone is a smart phone, a process in which the method according to steps S110 to S150 is executed can be programmed, produced as one application, and then stored in the smart phone. A card can be photographed using the camera included in the smart phone by driving the application.

A process of producing the application driven in the smart phone is known, and a detailed description thereof is omitted.

The mobile phone further includes a storage unit (not shown) for storing a card image captured by the camera, an image processing unit (not shown) for receiving the card image stored in the storage unit and performing image processing using the method according to steps S120 to S150 to be described later, and a display unit (not shown) for displaying the image processed by the image processing unit.

The mobile phone further includes a user interface unit (not shown) for a manipulation, such as the photographing of a card.

The user interface unit is commonly a key input unit, but may be an interface, such as a joystick or a touch screen, according to circumstances.

The storage unit can store programmed data of the process in which the method according to step S110 and steps S120 to S150 to be described later is executed, application data and the like in addition to the captured image data.

In general, the image processing unit performs a function of displaying an image signal, captured by the camera included in the mobile phone and received, on the display unit, performs image processing on the captured card image using the method according to steps S120 to S150 to be described later, and transfers the processed image to the display unit.

The display unit can be formed of a Liquid Crystal Display (LCD) or the like and displays images processed using the method according to steps S120 to S150 to be described later and various type of display data generated in the mobile phone. Here, if the LCD is implemented using a touch screen method, the display unit may operate as a user interface unit.

When the card is photographed using the input device of a mobile phone or the like and the card image 100 is stored in the storage unit as described above, the outermost line 210 of the card is detected from the obtained card image 100, an extraction image 200 is obtained, and a pattern (230) part of the card is extracted from the extraction image 200.

In order to extract the pattern 230 of the card, a method of producing a window of one line to which weight is given if a middle part of a filter is a dark color and outer parts on both sides of the filter are bright colors because a dark pattern is formed between bright backgrounds in most cards and generating a map by performing calculation in eight directions including horizontal, vertical, and diagonal directions can be used.

Binarization is performed according to an Otsu method using the map generated as described above, and only lines are extracted through thinning. Next, when the lines are extracted, the outermost line is searched for trough Hough conversion.

The pattern (230) part within the card can be detected by binarizing only the inside of the outermost line based on the retrieved outermost line.

In order to reduce an error, only one part needs to be selected and processed because there is a great difference in the color tone between the background and pattern (230) part of the card. In the present invention, only a bright part was selected and a change of a color tone in the selected bright part was viewed because a difference in the color tone of the bright part rather than a dark part has better experiment results.

In order to measure the degree that the color tone has been deformed, a difference between three signals forming pixels, that is, red light (R), green light (G), and blue light B, needs to be measured because the red light (R), that is, first light, the green light (G), that is, second light, and the blue light B, that is, third light, are inputted to the input device for capturing the image.

Meanwhile, the first light may be green or blue, the second light may be red or blue, and the third light may be red or green. In the present invention, however, it will be preferred that the first light be red, the second light be green, and the third light be blue consistently.

The image includes a lot of noise.

Different pieces of light at several angles not constant light from which the image will be obtained are inputted to a camera, and the different pieces of light also have different intensities.

Light that is constant to some extent is inputted to a scanner in order to obtain an image from the light. A process in which the light is converted into a digital signal is described below. The light first passes through a lens, passes through an anti-aliasing (blurring) filter, and reaches a pixel via a Color Filter Array (CFA). The pixel is converted into a signal through an A/D converter because the pixel absorbs photons of the light. Thereafter, the converted signal is subject to color adjustment, gamma adjustment and the like, compressed, and then stored.

Accordingly, since noise is introduced in each step for obtaining an image as described above, the obtained image is not uniform although a very uniform place is photographed.

A normalization process for removing the intensity of light and an influence in which a color tone is changed depending on the input characteristics of the first light, the second light, and the third light that form pixels is necessary (step S120).

First, a dark and shade value $Gray_{(x,y)}$ for each pixel is extracted from the obtained extraction image 200 in accordance with Mathematical Equation 1.

$$Gray_{(x,y)} = \frac{R_{(x,y)} + G_{(x,y)} + B_{(x,y)}}{3} \quad \text{[Mathematical Equation 1]}$$

Here, $R_{(x,y)}$ is the first light forming a pixel, $G_{(x,y)}$ is the second light forming a pixel, $B_{(x,y)}$ is the third light forming a pixel, and (x, y) is the coordinates of the pixel.

Next, the dark and shade value $Gray_{(x,y)}$ in one pixel needs to be substantially the same as an average dark and shade value.

Accordingly, regarding a value of the pixel in which the above condition is considered, an average dark and shade value $Gray_{(mean)}$ for the sum of the dark and shade values $Gray_{(x,y)}$ is calculated, first average light 260 in which the average dark and shade value $Gray_{(mean)}$ has been applied to the first light is calculated in accordance with Mathematical Equation 2, second average light 270 in which the average dark and shade value $Gray_{(mean)}$ has been applied to the second light is calculated in accordance with Mathematical Equation 3, and third average light 280 in which the average dark and shade value $Gray_{(mean)}$ has been applied to the third light is calculated in accordance with Mathematical Equation 4.

$$R'_{(x,y)} = \frac{R_{(x,y)}}{Gray_{(x,y)}} \times Gray_{(mean)} \quad \text{[Mathematical Equation 2]}$$

$$G'_{(x,y)} = \frac{G_{(x,y)}}{Gray_{(x,y)}} \times Gray_{(mean)} \quad \text{[Mathematical Equation 3]}$$

$$B'_{(x,y)} = \frac{B_{(x,y)}}{Gray_{(x,y)}} \times Gray_{(mean)} \quad \text{[Mathematical Equation 4]}$$

Here, $R'_{(x,y)}$ is the first average light 260 in which the average dark and shade value has been applied to the first light, $G'_{(x,y)}$ is the second average light 270 in which the average dark and shade value has been applied to the second light, and $B'_{(x,y)}$ is the third average light 280 in which the average dark and shade value has been applied to the third light.

Next, as shown in FIG. 3, the histograms of the first average light 260, the second average light 270, and the third average light 280 are calculated. As shown in FIG. 4, first normal light 265, second normal light 275, and third normal light 285 normalized by Mathematical Equation 5 and Mathematical Equation 6 are calculated so that the histograms of the remaining two pieces of average light are stretched on the basis of the histogram for any one piece of average light.

$$R''_{(x,y)} = 255 \times \frac{R'_{(x,y)} - G'_{(min)}}{G'_{(max)} - G'_{(min)}} \times Gray_{(mean)} \quad \text{[Mathematical Equation 5]}$$

-continued $$B''_{(x,y)} = 255 \times \frac{B'_{(x,y)} - G'_{(min)}}{G'_{(max)} - G'_{(min)}} \times Gray_{(mean)}, \quad \text{[Mathematical Equation 6]}$$

Here, $R''_{(x,y)}$ is the first normal light 265 histogram-stretched from the first average light 260 on the basis of the histogram of the second average light 270, $B''_{(x,y)}$ is the third normal light 285 histogram-stretched from the third average light 280 on the basis of the histogram of the second average light 270, $G'_{(min)}$ is a minimum value of the second average light 270, and $G'_{(max)}$ is a maximum value of the second average light 270.

Here, the second normal light 275 can be expressed by $G''_{(x,y)}$, and $G''_{(x,y)}$ is the same as the second average light 270.

The intensities of the plurality of pieces of light forming the pixel have become constant by performing the normalization as described above, and the influence of light and a phenomenon in which a color tone is distorted have been removed to the highest degree by controlling the histograms of the first average light 260 and the third average light 280 on the basis of the histogram of the second average light 270.

In the present invention, the histograms of the first average light 260 and the third average light 280 have been stretched on the basis of the histogram of the second average light 270, but the present invention is not limited thereto. The histograms of the second average light 270 and the third average light 280 may be stretched on the basis of the histogram of the first average light 260, and the histograms of the first average light 260 and the second average light 270 may be stretched on the basis of the histogram of the third average light 280.

Meanwhile, the paths of light that passes through two different media when the two different media come in contact with each other are bent because the speed of light is different in the two different media. The degree that a refractive index of light according to the medium of color is deformed can be indicated by a difference in the color tone between two pieces of normal light not overlapping with each other, from among the first normal light 265, the second normal light 275, and the third normal light 285 (step S130).

Accordingly, the degree that a refractive index of light according to the medium of color is deformed can be indicated by a difference in the color tone between the first normal light 265 and the second normal light 275, a difference in the color tone between the first normal light 265 and the third normal light 285, and a difference in the color tone between the second normal light 275 and the third normal light 285.

First, an absolute value for the difference between the first normal light 265 and the second normal light 275 is calculated in accordance with Mathematical Equation 7, an absolute value for the difference between the first normal light 265 and the third normal light 285 is calculated in accordance with Mathematical Equation 8, and an absolute value for the difference between the second normal light 275 and the third normal light 285 is calculated in accordance with Mathematical Equation 9.

$$K_{1(x,y)} = |R''_{(x,y)} - G''_{(x,y)}| \quad \text{[Mathematical Equation 7]}$$

$$K_{2(x,y)} = |R''_{(x,y)} - B''_{(x,y)}| \quad \text{[Mathematical Equation 8]}$$

$$K_{3(x,y)} = |G''_{(x,y)} - B''_{(x,y)}| \quad \text{[Mathematical Equation 9]}$$

Next, first chrominance light, second chrominance light, and third chrominance light are calculated by matching the absolute values with the first chrominance light, the second chrominance light, and the third chrominance light that form one pixel, respectively.

Here, $K_{1(x,y)}$ is the first chrominance light matched with the absolute value for the difference between the first normal light 265 and the second normal light 275, $K_{2(x,y)}$ is the second chrominance light matched with the absolute value for the difference between the first normal light 265 and the third normal light 285, and $K_{3(x,y)}$ is the third chrominance light matched with the absolute value for the difference between the second normal light 275 and the third normal light 285.

However, this difference in the color tone has a different degree of deformation and a different deviation depending on an angle of light.

Accordingly, after the first chrominance light, the second chrominance light, and the third chrominance light are calculated, the histograms of the first chrominance light, the second chrominance light, and the third chrominance light are calculated and then stretched into a uniform distribution in accordance with Mathematical Equation 10, Mathematical Equation 11, and Mathematical Equation 12 (step S140).

$$K'_{1(x,y)} = 255 \times \frac{K_{1(x,y)} - K_{1(min)}}{K_{1(max)} - K_{1(min)}} \quad \text{[Mathematical Equation 10]}$$

$$K'_{2(x,y)} = 255 \times \frac{K_{2(x,y)} - K_{2(min)}}{K_{2(max)} - K_{2(min)}} \quad \text{[Mathematical Equation 11]}$$

$$K'_{3(x,y)} = 255 \times \frac{K_{3(x,y)} - K_{3(min)}}{K_{3(max)} - K_{3(min)}} \quad \text{[Mathematical Equation 12]}$$

Here, $K'_{1(x,y)}$ is first distribution light calculated by histogram stretching for the first chrominance light, $K_{1(min)}$ is a minimum value of the first chrominance light, $K_{1(max)}$ is a maximum value of the first chrominance light, $K'_{2(x,y)}$ is second distribution light calculated by histogram stretching for the second chrominance light, $K_{2(min)}$ is a minimum value of the second chrominance light, $K_{2(max)}$ is a maximum value of the second chrominance light, $K'_{3(x,y)}$ is third distribution light calculated by histogram stretching for the third chrominance light, $K_{3(min)}$ is a minimum value of the third chrominance light, and $K_{3(max)}$ is a maximum value of the third chrominance light.

A first detection image 300 in which the invisible mark 350 of the card appears can be obtained by calculating the first distribution light, the second distribution light, and the third distribution light that form one pixel as described above, as shown in FIG. 5.

Meanwhile, since the thickness of ink that forms the invisible mark 350 in the card is constant, the degree that a color tone of light passing through the invisible mark 350 is deformed needs to be identical and needs to be smoothly changed depending on a difference between light sources.

However, a lot of noise, such as white Gaussian noise, is included in the first detection image 300 through the first distribution light, the second distribution light, and the third distribution light that form one pixel, which are calculated according to Mathematical Equations 10 to 12.

Therefore, in order to remove the noise, a Wiener filter using a probabilistic restoration method of minimizing a difference between the original image and a restored image from a viewpoint of Minimum Mean Square Error (MMSE) was used (step S150).

Next, a second detection image 400 from which noise has been removed and in which an invisible mark 450 appears can be obtained by removing unwanted values or significant values using the A Wiener filter as shown in FIG. 6.

The second detection image 400 can be displayed through the display unit of the mobile phone.

Figure 8:
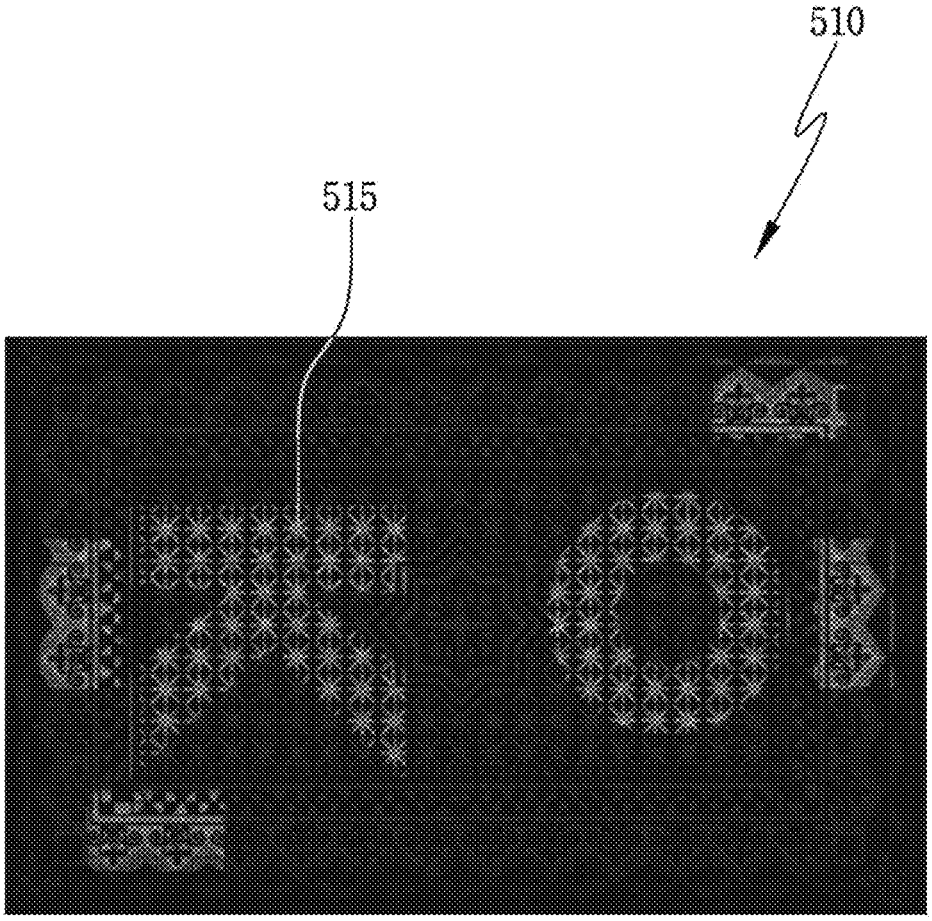
FIG. 8 is an exemplary diagram showing an ultraviolet marking card in which an invisible mark appears in an ultraviolet region.
Figure 9:
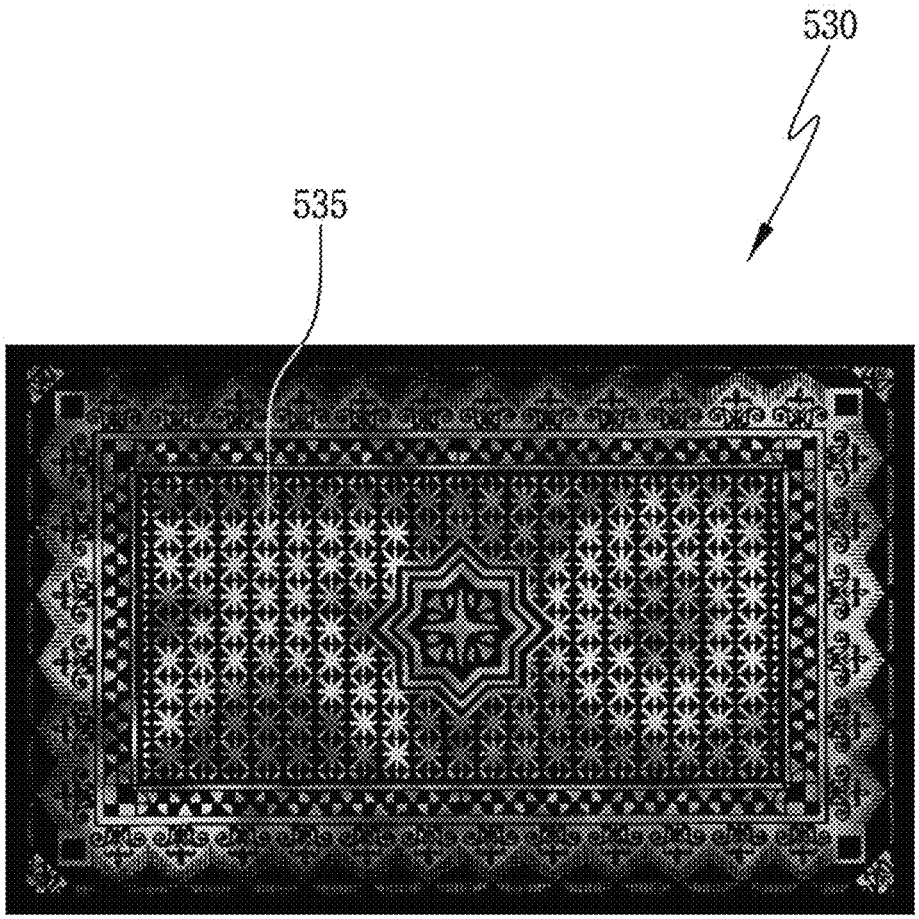
FIG. 9 is an exemplary diagram illustrating the state in which the invisible mark has been detected in the ultraviolet marking card of FIG. 8 using the method in accordance with an embodiment of the present invention.
Figure 10:
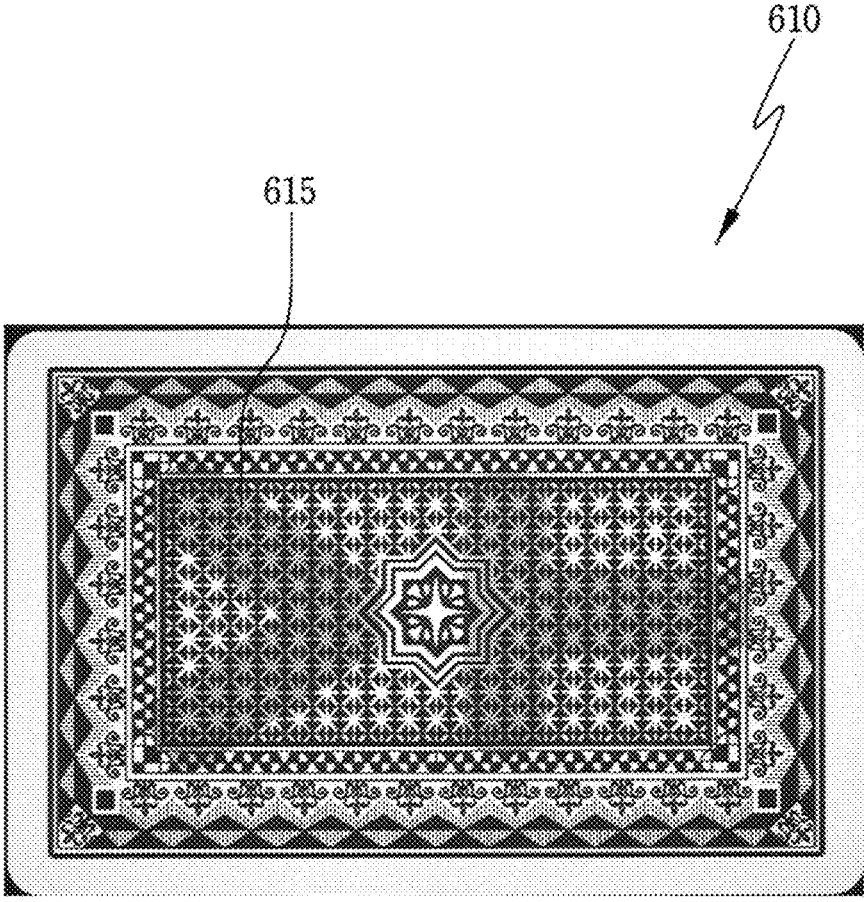
FIG. 10 is an exemplary diagram illustrating an infrared marking card in which an invisible mark appears in an infrared region.
Figure 11:
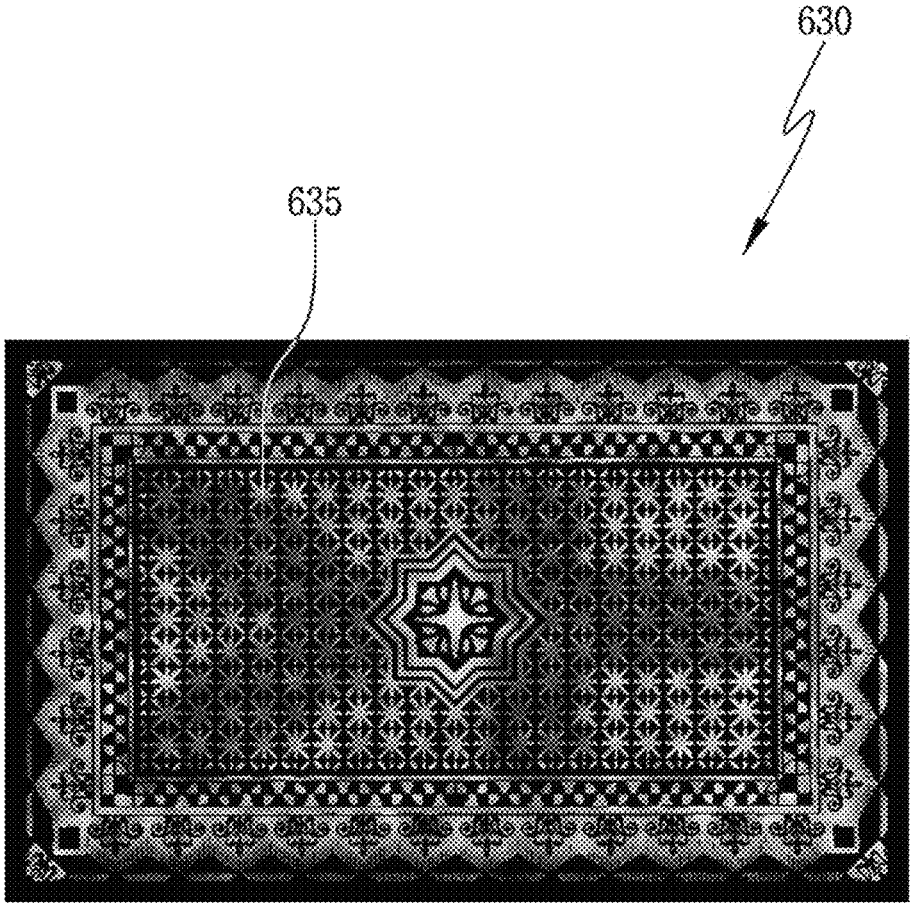
FIG. 11 is an exemplary diagram illustrating the state in which the invisible mark has been detected in the infrared marking card of FIG. 10 using the method in accordance with an embodiment of the present invention.

FIG. 8 is an exemplary diagram showing an ultraviolet marking card in which an invisible mark appears in an ultraviolet region, FIG. 9 is an exemplary diagram illustrating the state in which the invisible mark has been detected in the ultraviolet marking card of FIG. 8 using the method in accordance with an embodiment of the present invention, FIG. 10 is an exemplary diagram illustrating an infrared marking card in which an invisible mark appears in an infrared region, and FIG. 11 is an exemplary diagram illustrating the state in which the invisible mark has been detected in the infrared marking card of FIG. 10 using the method in accordance with an embodiment of the present invention.

Cards in which invisible marks appear include an ultraviolet marking card in which an invisible mark 515 appears in an ultraviolet image 510 as shown in FIG. 8 and an infrared marking card in which an invisible mark 615 appears in an infrared image 610 as shown in FIG. 10.

If the two types of card images are inputted to the input device of a mobile phone, etc. and processed using the method in accordance with an embodiment of the present invention, it can be seen that invisible marks 535 and 635 appear in respective visible ray images 530 and 630 through the display unit, as shown in FIGS. 9 and 11, like in that appearing in the ultraviolet image 510 or the infrared image 610.

Accordingly, if the method according to steps S110 to S150 is programmed, produced as one application, stored in a smart phone, and the application is subsequently driven, when a user photographs a card using the camera of the smart phone, the invisible marks 535 and 635 appear in the respective visible ray images 530 and 630 as shown in FIGS. 9 and 11, like in that appearing in the ultraviolet image 510 or the infrared image 610.

In this case, fraudulent victims that may be attributable to fraudulent gambling can be prevented, and whether or not a card is a fraudulent card can be determined during card playing in businesses, such as casino.

Furthermore, the method according to steps S110 to S150 according to the present invention may be programmed and stored in a recording medium, such as CD-ROM, memory, ROM, or EEPROM, so that the stored program can be read by a computer in addition to a mobile phone including a smart phone.

If whether or not an invisible mark is present can be immediately checked using a mobile phone or a camera, fraudulent victims that may be attributable to fraudulent gambling can be prevented, and whether or not a card is a fraudulent card can be determined during card playing in businesses, such as casino.

The method in accordance with an embodiment of the present invention may be stored in a scanner, a common camera, or the like and used to detect an invisible mark.

Figure 12:
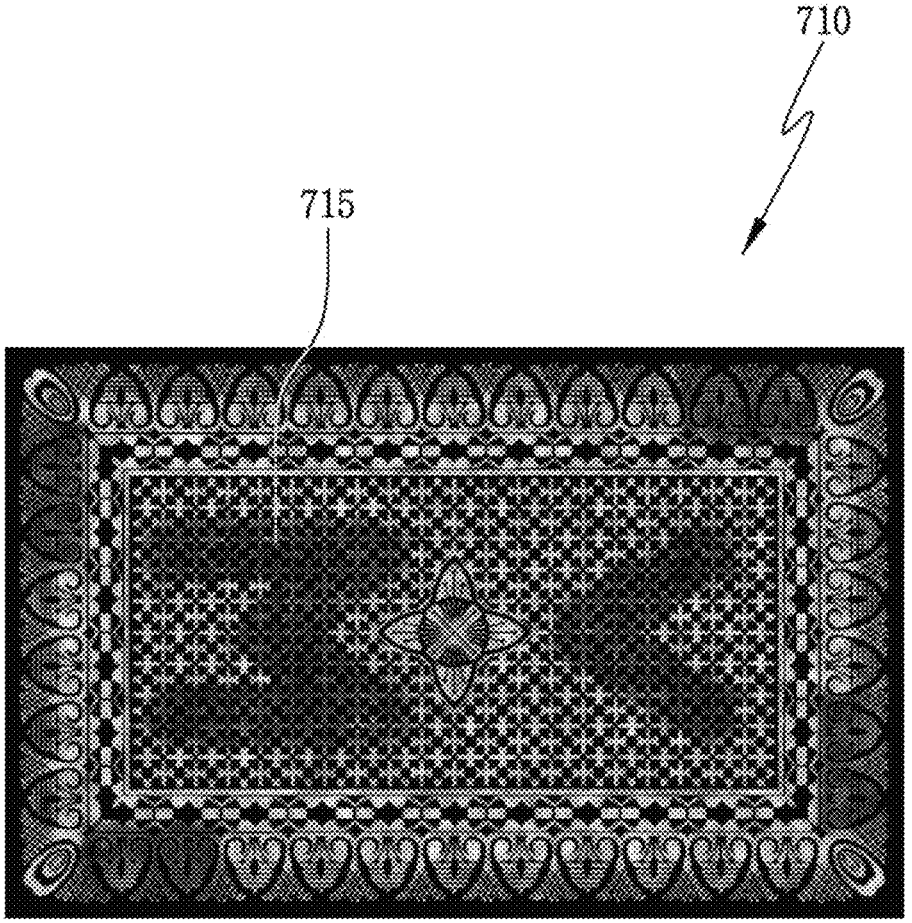
FIG. 12 is an exemplary diagram illustrating the state in which an invisible mark has been detected by applying the method in accordance with an embodiment of the present invention to a scanner.

FIG. 12 is an exemplary diagram illustrating the state in which an invisible mark has been detected by applying the method in accordance with an embodiment of the present invention to a scanner.

It can be seen that an invisible mark 715 clearly appears in a scan image 710 of a card obtained using the scanner although the scanner has low resolution because a light source is constant.

Figure 13:
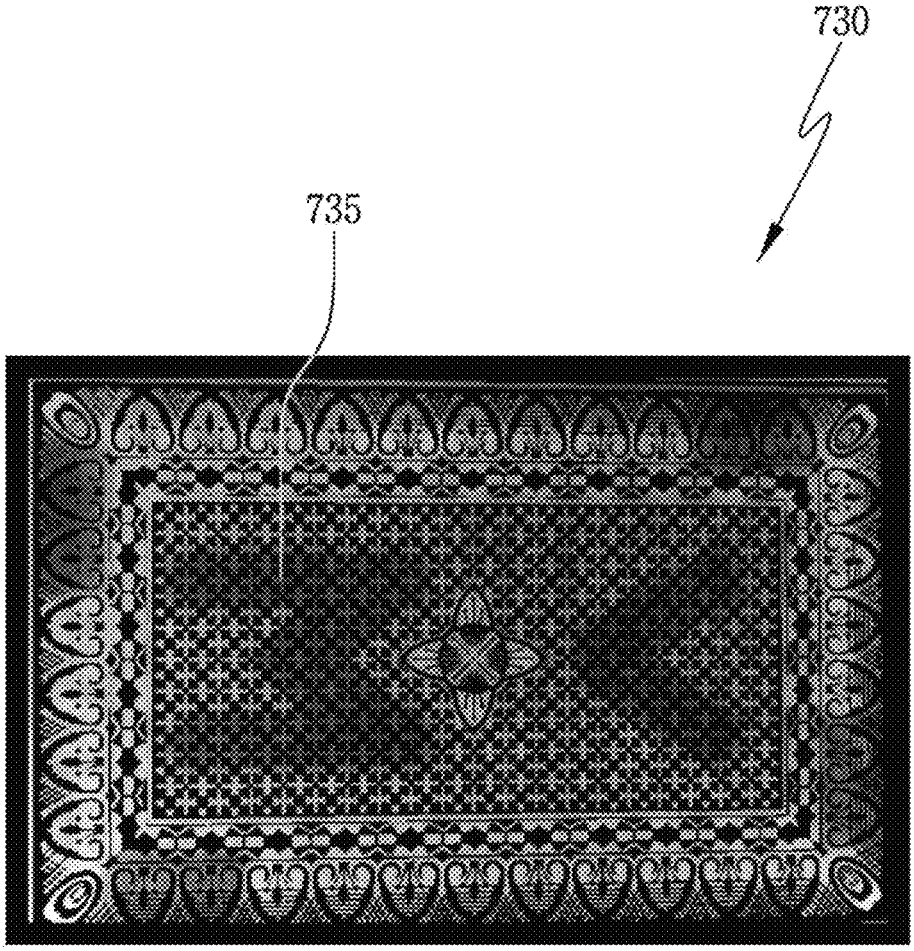
FIG. 13 is an exemplary diagram illustrating the state in which an invisible mark has been detected by applying the method in accordance with an embodiment of the present invention to a common camera.

FIG. 13 is an exemplary diagram illustrating the state in which an invisible mark has been detected by applying the method in accordance with an embodiment of the present invention to a common camera.

It can be seen that an invisible mark 735 clearly appears in a camera image 730 of a card obtained using the common camera.

Figure 14:
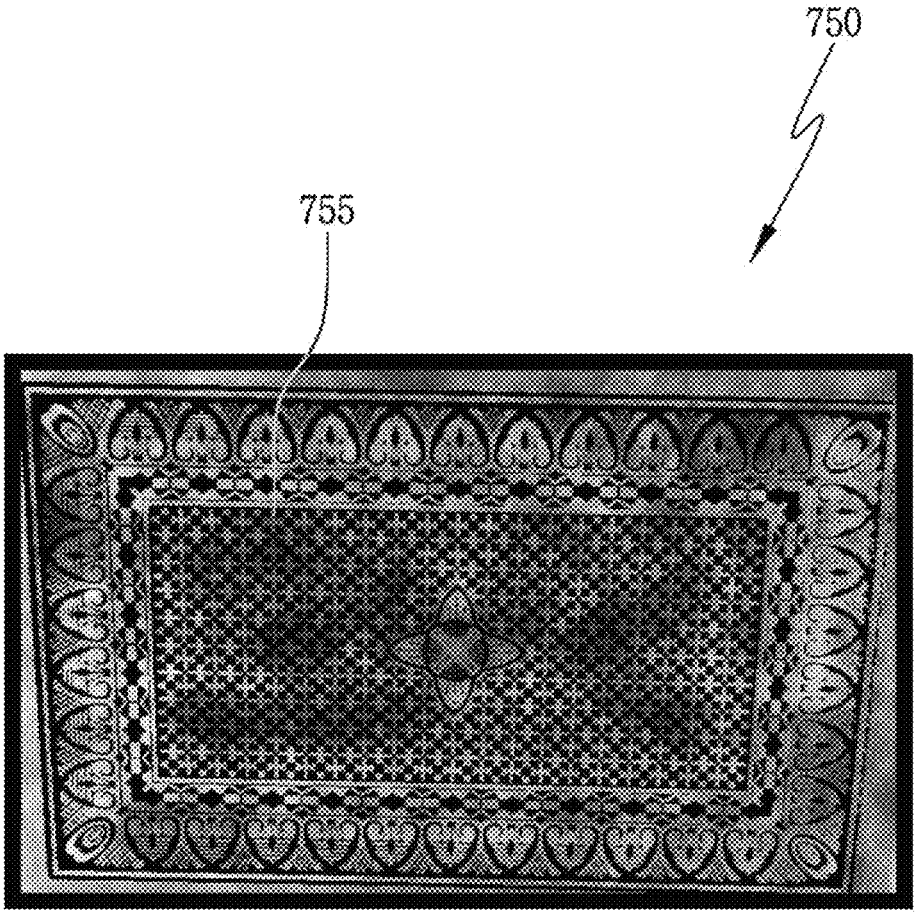
FIG. 14 is an exemplary diagram illustrating the state in which an invisible mark has been detected by applying the method in accordance with an embodiment of the present invention to a mobile phone.

FIG. 14 is an exemplary diagram illustrating the state in which an invisible mark has been detected by applying the method in accordance with an embodiment of the present invention to a mobile phone.

It can be seen that an invisible mark 755 appears in a mobile phone image 750 of a card obtained using the mobile phone although the invisible mark 755 is not clear.

In the case of the mobile phone image 750, the degree that the invisible mark 755 appears can be determined depending on quality of a camera. In view of the degree that hardware performance is developed, an invisible mark can clearly appear even in a mobile phone image if a camera equivalent to a common camera is mounted on a mobile phone.

Meanwhile, in the case of a mobile phone in which the method in accordance with an embodiment of the present invention has not been programmed and stored or in which a corresponding application has not been installed although the mobile phone is equipped with a camera, a card image captured by the mobile phone can be transmitted to a mobile phone in which the method in accordance with an embodiment of the present invention has been programmed and stored or in which a corresponding application has been installed.

Accordingly, in the mobile phone that has received the card image, an invisible mark within a card can be detected using the method in accordance with the present invention.

Although the preferred embodiment of the present invention has been described above, the present invention is not necessarily limited to the preferred embodiment. It can be easily understood that a person having ordinary skill in the art to which the present invention pertains may substitute, modify, and change the present invention in various ways without departing from the technical spirit of the present invention.

What is claimed is:

1. A method of detecting an invisible mark in a card, comprising:

(a) a normalization step for calculating first normal light, second normal light, and third normal light by normalizing first light, second light, and third light that form respective pixels in an extraction image of the card;

(b) a chrominance calculation step for obtaining first chrominance light, second chrominance light, and third chrominance light by calculating a difference in a color tone between two pieces of normal light not overlapping with each other, from among the first normal light, the second normal light, and the third normal light normalized in the step (a); and (c) an image acquisition step for calculating histograms of the first chrominance light, the second chrominance light, and the third chrominance light calculated in the step (b) and obtaining a detection image of the card by stretching the histograms so that first distribution light, second distribution light, and third distribution light forming one pixel are calculated, wherein the normalization step comprises steps of:

calculating a dark and shade value $Gray_{(x,y)}$ for each pixel;

calculating an average dark and shade value $Gray_{(mean)}$ for a sum of the dark and shade values $Gray_{(x,y)}$;

calculating first average light, second average light, and third average light by applying the average dark and shade value $Gray_{(mean)}$ to the first light, the second light, and the third light; and calculating the first normal light, the second normal light, and the third normal light by stretching histograms of two different average lights, from among the first average light, the second average light, and the third average light, based on a histogram of a remaining one average light, from among the first average light, the second average light, and the third average light, that is different from the two different average lights, further wherein each of the dark and shade values $Gray_{(x,y)}$ is calculated by $$Gray_{(x,y)} = \frac{R_{(x,y)} + G_{(x,y)} + B_{(x,y)}}{3}$$

(wherein $R_{(x,y)}$ is the first light forming a specific pixel, $G_{(x,y)}$ is the second light forming the specific pixel, $B_{(x,y)}$ is the third light forming the specific pixel, and (x, y) is coordinates of the specific pixel), the first average light, the second average light, and the third average light are calculated by $$R'_{(x,y)} = \frac{R_{(x,y)}}{Gray_{(x,y)}} \times Gray_{(mean)},\ G'_{(x,y)} = \frac{G_{(x,y)}}{Gray_{(x,y)}} \times Gray_{(mean)},$$

$$\text{and } B'_{(x,y)} = \frac{B_{(x,y)}}{Gray_{(x,y)}} \times Gray_{(mean)},$$

respectively (wherein $R'_{(x,y)}$ is the first average light in which the average dark and shade value $Gray_{(x,y)}$ has been applied to the first light, $G'_{(x,y)}$ is the second average light in which the average dark and shade value $Gray_{(x,y)}$ has been applied to the second light, and $B'_{(x,y)}$ is the third average light in which the average dark and shade value $Gray_{(x,y)}$ has been applied to the third light), and the first normal light, the second normal light, and the third normal light are calculated by $$R''_{(x,y)} = 255 \times \frac{R'_{(x,y)} - G'_{(min)}}{G'_{(max)} - G'_{(min)}} \times Gray_{(mean)},$$

$$B''_{(x,y)} = 255 \times \frac{B'_{(x,y)} - G'_{(min)}}{G'_{(max)} - G'_{(min)}} \times Gray_{(mean)},$$

and $G''_{(x,y)}$, respectively (wherein $R''_{(x,y)}$ is the first normal light that is histogram-stretched from the first average light based on the histogram of the second average light, $B''_{(x,y)}$ is the third normal light that is histogram-stretched from the third average light based on the histogram of the second average light, $G''_{(x,y)}$ is the second normal light and is identical with the second average light, $G'_{(min)}$ is a minimum value of the second average light, and $G'_{(max)}$ is a maximum value of the second average light).

2. The method of claim 1, wherein the chrominance calculation step comprises steps of:

calculating an absolute value for a difference between the first normal light and the second normal light, an absolute value for a difference between the first normal light and the third normal light, and an absolute value for a difference between the second normal light and the third normal light; and matching the absolute values with the first chrominance light, the second chrominance light, and the third chrominance light, respectively.

3. The method of claim 2, wherein the first chrominance light, the second chrominance light, and the third chrominance light are calculated by $K_{1(x,y)}=|R''_{(x,y)}-G''_{(x,y)}|$, $K_{2(x,y)}=|R''_{(x,y)}-B''_{(x,y)}|$, and $K_{3(x,y)}=|G''_{(x,y)}-B''_{(x,y)}|$, respectively (wherein $K_{1(x,y)}$ is the first chrominance light matched with the absolute value for the difference between the first normal light and the second normal light, $K_{2(x,y)}$ is the second chrominance light matched with the absolute value for the difference between the first normal light and the third normal light, and $K_{3(x,y)}$ is the third chrominance light matched with the absolute value for the difference between the second normal light and the third normal light).

4. The method of claim 3, wherein the image acquisition step comprises steps of:

calculating the histograms of the first chrominance light, the second chrominance light, and the third chrominance light; and calculating the first distribution light, the second distribution light, and the third distribution light forming the one pixel by stretching the histograms of the first chrominance light, the second chrominance light, and the third chrominance light.

5. The method of claim 4, wherein the first distribution light, the second distribution light, and the third distribution light are calculated by $$K'_{1(x,y)} = 255 \times \frac{K_{1(x,y)} - K_{1(min)}}{K_{1(max)} - K_{1(min)}},\ K'_{2(x,y)} = 255 \times \frac{K_{2(x,y)} - K_{2(min)}}{K_{2(max)} - K_{2(min)}},$$

-continued $$\text{and } K'_{3(x,y)} = 255 \times \frac{K_{3(x,y)} - K_{3(min)}}{K_{3(max)} - K_{3(min)}},$$

respectively (wherein $K'_{1(x,y)}$ is the first distribution light calculated by the histogram stretching for the first chrominance light, $K_{1(min)}$ is a minimum value of the first chrominance light, $K_{1\ (max)}$ is a maximum value of the first chrominance light, $K'_{2(x,y)}$ is the second distribution light calculated by the histogram stretching for the second chrominance light, $K_{2(min)}$ is a minimum value of the second chrominance light, $K_{2(max)}$ is a maximum value of the second chrominance light, $K'_{3(x,y)}$ is the third distribution light calculated by the histogram stretching for the third chrominance light, $K_{3(min)}$ is s a minimum value of the third chrominance light, and $K_{3(max)}$ is a maximum value of the third chrominance light).

6. The method of claim 1, further comprising a step of capturing the extraction image of the card through a camera embedded in a mobile phone or transmitting the extraction image to a mobile phone and storing the transmitted extraction image.

7. A non-transitory, tangible, computer-readable recording medium on which a program for executing a control method of claim 1 is recorded.

8. A non-transitory, tangible, computer-readable recording medium on which a program for executing a control method of claim 5 is recorded.

* * * * *